United States Patent [19]

Thompson

[11] 4,048,719

[45] Sept. 20, 1977

[54] CARTON OPENER

[76] Inventor: Mary Kay Thompson, 6740 Commerce Road, Orchard Lake, Mich. 48033

[21] Appl. No.: 658,679

[22] Filed: Feb. 17, 1976

[51] Int. Cl.[2] ..... B67B 7/30; B26B 5/00

[52] U.S. Cl. ..... 30/2; 30/293; 30/294; 30/320

[58] Field of Search ..... 30/2, 31, 293, 294, 30/317, 320

[56] References Cited

U.S. PATENT DOCUMENTS

| | | | |
|---|---|---|---|
| 1,288,522 | 12/1918 | Cowan | 30/31 |
| 2,566,493 | 9/1951 | Ladd | 30/320 X |
| 3,153,853 | 10/1964 | Lipton | 30/294 |
| 3,380,159 | 4/1968 | Winston | 30/317 X |
| 3,543,400 | 12/1970 | Scott | 30/294 X |
| 3,831,274 | 8/1974 | Horrocks | 30/294 X |

*Primary Examiner*—Gary L. Smith

*Attorney, Agent, or Firm*—Gifford, Chandler, Sheridan & Sprinkle

[57] ABSTRACT

A hand-held cutting device is provided for opening cartons, such as cardboard boxes, without damaging the contents within the carton. The cutting device comprises a handle having an elongated flat bottom surface which is adapted to slide along the outer surface of the carton during a cutting operation. A cutting blade is secured to the handle and extends outwardly through an opening in the bottom surface of the handle for engaging and cutting the carton. A guard is secured to the cutting blade across its outwardly extending end and includes a portion extending forwardly of the cutting edge of the cutting blade. This forward portion of the guard is curved towards the handle and serves to deflect the contents of the carton away from the cutting blade during a cutting operation. Preferably the upper front edge of the guard forms a second cutting edge so that the guard easily pierces the carton during the initiation of a cutting operation.

6 Claims, 5 Drawing Figures

Fig-1
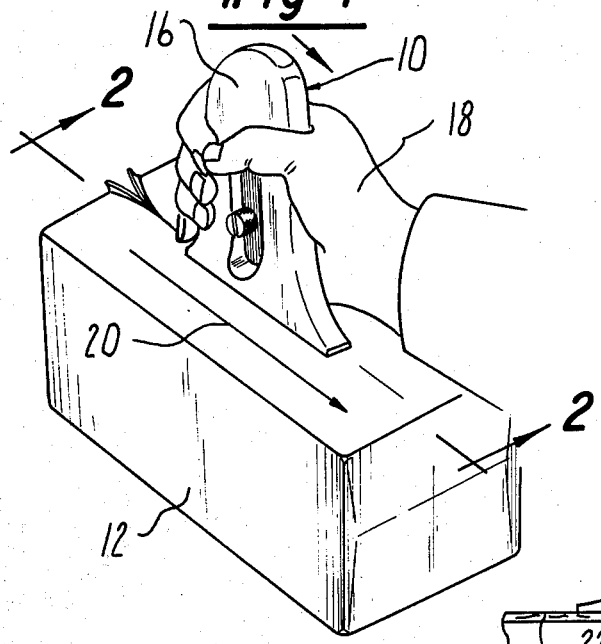
Fig-2
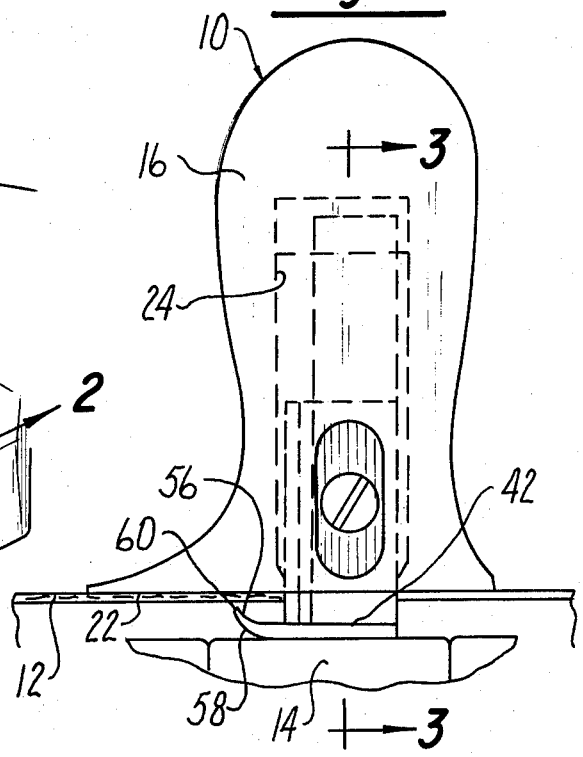
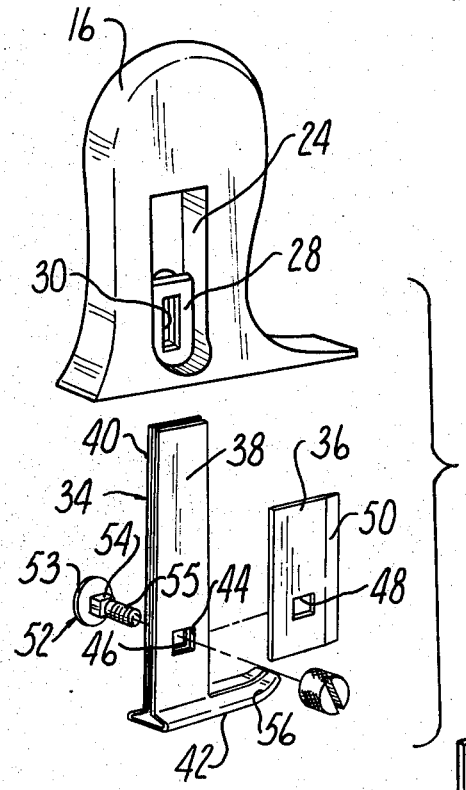
Fig-4
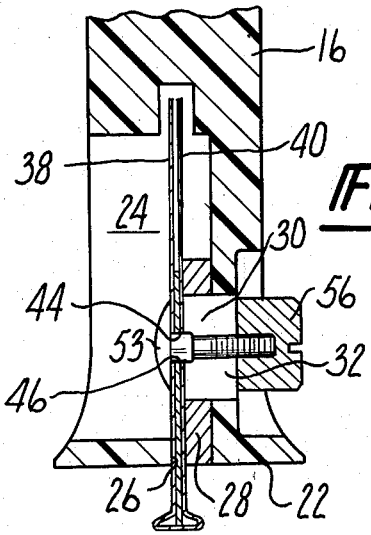
Fig-3
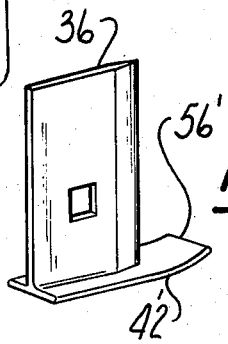
Fig-5

CARTON OPENER

BACKGROUND OF THE INVENTION

I. Field of the Invention

The present invention relates generally to cutting devices and, more particularly, to a cutting device for cutting open cartons.

II. Description of the Prior Art

There have been several previously known cutting devices which are particularly adapted for opening cardboard cartons or the like. These previously known devices are typically of simple construction and comprise a handle having a cutting blade extending outwardly from the handle. Thus to open a carton, the handle is merely drawn along the carton so that the cutting blade enters into and cuts open the carton.

One disadvantage of these previously known carton openers is that the blade often extends too deeply into the carton so that the cutting blade sometimes contacts and cuts the contents of the carton. Consequently, the contents of the carton are damaged as the carton is opened.

A still further disadvantage of these previously known carton openers is that the depth of cut of the cutting blade is fixed rather than adjustable. Thus, a carton opener with a relatively shallow depth of cut would be inadequate to open a thick carton, while conversely a carton opener with a relatively deep cutting penetration tends to damage the contents of a relatively thin-walled carton.

A still further disadvantage of the previously known carton opening devices is that the cutting blade is supported only at its connection point with the handle. The cutting blade, typically a thin razor blade or the like, thus frequently breaks while in use or otherwise. Such blade breakage, of coure, necessitates frequent replacement of the blade which is not only a nuisance, but also an added cost.

Yet another disadvantage of these previously known carton openers is that the user is often injured by the cutting blade, typically through carelessness during a cutting operation. This safety hazard is due primarily to the previously known constructions in which the razor blade is exposed and accordingly unprotected.

SUMMARY OF THE PRESENT INVENTION

The carton opener of the present invention obviates the abovementioned disadvantages of the previously known carton openers by providing a carton opener in which not only the user, but also the contents of the carton are protected from injury from the cutting blade.

In brief, the carton opener of the present invention comprises a handle having a cutting blade secured thereto and extending outwardly through an opening in the bottom surface of the handle. A guard is positioned across the exposed end of the cutting blade and includes a portion extending forwardly of the cutting blade. This foward portion of the guard is curved upwardly towards the handle so that during a cutting operation, the curvilinear forward portion of the guard deflects the contents of the carton down and away from the cutting blade. Moreover, the guard supports and protects the blade from breakage and also serves to protect the user against accidental injury from the cutting blade.

In the preferred form of the invention, the cutting blade is slidably mounted to the handle so that the depth of cut of the cutting blade may be adjusted. Locking means are also provided to lock the cutting blade in position relative to the handle when the desired depth of cut is achieved.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which:

FIG. 1 is a perspective view showing a cutting operation utilizing the carton opener of the present invention;

FIG. 2 is a partial cross-sectional view taken substantially along line 2—2 in FIG. 1;

FIG. 3 is a fragmentary cross-sectional view of the carton opener of the present invention taken substantially along lines 3—3 in FIG. 2;

FIG. 4 is an exploded perspective view showing the carton opener of the present invention; and FIG. 5 is a perspective view showing a modification of the cutting blade for the carton opener of the present invention.

DETAILED DESCRIPTION OF THE PRESENT INVENTION

Referring first to FIGS. 1 - 4, the carton opener 10 of the present invention is thereshown opening a carton 12 typically constructed of cardboard and having contents 14 within the carton 12. The carton opener 10 comprises a handle 16 which is preferably dimensioned so that it may be firmly gripped in the palm of the hand 18 of a user and pulled toward the user in the direction of arrow 20. In addition, the handle 16 includes a longitudinally elongated and flat bottom surface 22 which abuts against the outer surface of the carton 12 during a cutting operation.

A vertically elongated recess 24 (as seen in the drawing) is formed within the handle and includes a longitudinal slot 26 formed through the bottom surface 22 of the handle 16. A flat vertical support member 28 having a vertical slot 30 is secured within the recess 24 adjacent the slot 26 and preferably forms one elongated side of the slot 26 as shown in FIG. 3. The vertical slot 30 in the support member 28 registers with a second slot 32 formed through the handle 16 and the function of the support member 28 and slots 30 and 32 will become shortly hereinafter apparent.

A blade holder 34 is provided for securing a cutting blade 36, such as a razor blade, to the handle 16. The blade holder 34 is preferably of integral construction and comprises vertically elongated facing plate portions 38 and 40 and a guard 42 disposed across the lowermost end of the plate portions 38 and 40. The plate portions 38 and 40 further include registering square apertures 44 and 46, respectively, which also register with a square aperture 48 formed through the cutting blade 36. In addition, the plate portions 38 and 40 are so dimensioned that they may be slidably received through the slot 26 in the bottom surface 22 of the handle 16 and into the recess 24.

To assemble and secure the blade holder 34 to both the blade 36 and the handle 16, the cutting blade 36 is first positioned between plate portions 38 and 40 so that the square apertures 44, 46, and 48 all register with each other. The cutting blade 46 is of greater lateral width than the plate portions 38 and 40 so that the cutting edge 50 of the cutting blade 36 protrudes forwardly of and generally parallel to the plate portions 38 and 40 when the apertures 44, 46, and 48 are in alignment with each other.

The blade holder 34 is then inserted through the slot 26 of the handle bottom surface 22 so that the plate portions 38 and 40 extend into the recess 24 and the guard 42 is positioned below the handle bottom surface 22. The slot 26 is of sufficient longitudinal length so that a portion of the cutting blade 36 is received into the and through the slot 26. With the blade holder 34 positioned as thus far described, a bolt member 52 having an enlarged head 53 and a square portion 54 adjacent the head 53 is inserted through the apertures 44 and 46 in the blade holder 34 while the shank 55 of the bolt member 52 extends through the registering slots 30 and 32 in the support member 28 and handle 16, respectively. The square portion 54 of the bolt member 52 is of substantially the same cross-sectional shape as the apertures 44, 46, and 48 so that the square portion 54 locks and secures the blade holder 34 to the cutting blade 36. A nut 56 is screwed onto the bolt shank 55 and tightened so that the bolt head 53 compresses the blade holder 34 against the support member 28 and locks the blade holder 24 to the handle 16. The registering slots 30 and 32 in the support member 38 and handle 16, respectively, permit the blade holder 34 to be vertically slidably adjusted within the limits of the slots 30 and 32. The vertical position of the blade holder 34 controls the length of the razor blade 36 extending beneath the surface 22 and likewise determines the cutting depth of the carton opener 10.

The guard 42, which is preferably integral with the plate portions 38 and 40 as previously noted, is both laterally and longitudinally elongated thus forming a front portion 56 of the guide 42 which extends forwardly from the cutting edge 50 of the cutting blade 36. The front portion 56 of the guide 42 is curved upward towards the bottom surface 22 of the handle 16 thereby forming a lower curvilinear surface 58 on the front portion 56 of the guard 42. Thus during a cutting operation, the curvilinear surface 58 of the guide front portion 56 serves to deflect the contents 14 of the carton 12 downwardly and away from the cutting blade 36 as the carton opener 10 is drawn through the carton 12 as is best shown in FIG. 2. In addition, the forward tip 60 of the guard front portion 56 is preferably sharpened thus forming a short lateral cutting edge along the tip 60 of the guard front portion 56. The formation of the cutting edge along the front of the guard 42 is useful for intially piercing the carton 12 during the cutting operation.

Referring now to FIG. 5, a modification to the present invention is thereshown in which the guard 42' is formed integrally along the lower depending edge of the cutting blade 36'. In this modification, the blade holder 34 is rendered unnecessary since the blade 36 may be directly secured to the handle 16 by the bolt member 52.

It can thus be seen that the carton opener 10 of the present invention provides a simple and inexpensive carton opener in which the depth of cut of the cutting blade may be easily and rapidly adjusted. Moreover, the guard 42 along the lower depending edge of the cutting blade 36 serves to deflect the contents of the carton away from the cutting blade as the carton opener 10 is drawn through a carton 12. In addition, the guard 42 protects the user against injuries from the cutting blade 36 since the space between the guard 42 and the bottom surface 22 of the handle 16 is sufficiently narrow to preclude the admission of the user's fingers or the like. Moreover, the cutting blade 36 is rigidly supported by the plate portions 38 and 40 and the support member 28 so that breakage of the cutting blade 36 is greatly minimized. In addition, the vertically elongated plate portions 38 and 40 and the handle recess 24 provide a means whereby additional or spare cutting blades 36 may be stored in the handle 16 between the plate portions 38 and 40 and above the cutting blade 36 in use.

Having thus described my invention, many modifications thereto will become apparent to those skilled in the art to which it pertains without deviation from the spirit of the invention as defined by the scope of the appended claims.

I claim:

1. A hand-held device for opening cartons comprising:

a handle having a lower flat surface, a cutting blade secured to said handle and extending outwardly and downwardly from said flat surface, said cutting blade having a forwardly facing cutting edge and a lower, outwardly extending edge, wherein said cutting edge is adapted to cut a carton as said handle is moved in a forward direction, a guard secured across the lower, outwardly extending edge of said cutting blade and substantially perpendicular thereto, said guard including a portion extending forwardly of said cutting edge and forming a slot between said lower flat surface of said handle and said forwardly extending portion of said guard, a pair of facing and vertically elongated plate portions, said plate portions being secured at their lower ends to said guard and adapted to lockingly receive the cutting blade therebetween, said plate portions being slidably received through a longitudinal slot formed in the bottom surface of said handle, and means for simultaneously vertically adjustably locking said cutting blade and said plate portions to said handle and for varying the width of said slot.

2. The device as defined in claim 1, and in which said forwardly extending portion of said guard includes a lower curvilinear surface.

3. The invention as defined in claim 1, wherein said cutting blade and said plate portions include registering apertures which in turn register with a vertically elongated slot formed in said handle and wherein said means for locking comprises a bolt member extending through said cutting blade and said plate portion apertures and also through said vertically elongated slot in said handle and a nut adapted to threadably engage said bolt member.

4. The invention as defined in claim 3 and including a support member secured to said handle and having a vertically elongated slot in registration with and adjacent the vertically elongated slot in the handle.

5. The invention as defined in claim 1 and including a cutting edge formed laterally across the front end of the forward portion of the guard.

6. The invention as defined in claim 1, wherein said plate portions are integral with said guard.

* * * * *

UNITED STATES PATENT AND TRADEMARK OFFICE

CERTIFICATE OF CORRECTION

PATENT NO. : 4,048,719

DATED : September 20, 1977

INVENTOR(S) : Mary Kay Thompson

It is certified that error appears in the above-identified patent and that said Letters Patent are hereby corrected as shown below:

Col. 3, line 9, delete "the" (second occurrence).

Col. 3, line 24, delete "24", insert --34--.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*